US011255340B2

(12) United States Patent
Paddock

(10) Patent No.: US 11,255,340 B2
(45) Date of Patent: Feb. 22, 2022

(54) IMPELLER ATTACHMENT METHOD

(71) Applicant: ITT MANUFACTURING ENTERPRISES LLC., Wilmington, DE (US)

(72) Inventor: Douglas Paddock, Penn Yan, NY (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 273 days.

(21) Appl. No.: 15/723,899

(22) Filed: Oct. 3, 2017

(65) Prior Publication Data

US 2018/0023585 A1 Jan. 25, 2018

Related U.S. Application Data

(63) Continuation of application No. 13/186,647, filed on Jul. 20, 2011, now abandoned.

(Continued)

(51) Int. Cl.
*F04D 29/20* (2006.01)

(52) U.S. Cl.
CPC ..... *F04D 29/20* (2013.01)

(58) Field of Classification Search
CPC ..... F01D 11/20; F01D 11/22; F04D 29/20; F04D 29/0462; F04D 29/042; F04D 29/0563; F04D 29/052
See application file for complete search history.

(56) References Cited

U.S. PATENT DOCUMENTS 1,614,815 A * 1/1927 Wilson ..... E21B 17/042 285/27
1,637,628 A * 8/1927 Weisgerber ..... F16L 15/001 285/27

(Continued)

FOREIGN PATENT DOCUMENTS

| | | |
|---|---|---|
| DE | 4002712 | 8/1990 |
| RU | 79623 U1 | 1/2009 |
| RU | 2239725 C2 | 6/2013 |

OTHER PUBLICATIONS 1 page English Language Translation of DE4002712.
English language Abstract of RU2239725.
English language Abstract available for RU79623.

*Primary Examiner* — David E Sosnowski
*Assistant Examiner* — Wayne A Lambert
(74) *Attorney, Agent, or Firm* — Carter, DeLuca & Farrell LLP; Bret P. Shapiro; George Likourezos

(57) ABSTRACT

A pump is provided having an impeller in combination with a power transmission shaft. The impeller has a tapered bore with impeller threads. The power transmission shaft has a shaft end with tapered threads configured to couple directly to the impeller threads of the tapered bore of the impeller, to transmit torque directly through the tapered threads, and to provide self axial or radial alignment even if the coupling of the tapered threads and the impeller threads of the tapered bore start out of alignment. The tapered thread configuration substantially reduces investment in lifting equipment and time by maintenance personnel because it eliminates the need for maintenance personnel to precisely align the impeller threads and the tapered threads before attaching or removing the impeller and the tapered threads release much more quickly from the impeller than a standard thread configuration, reducing the number of turns the power (Continued)

transmission shaft must be rotated by hand to free it from the impeller.

16 Claims, 2 Drawing Sheets

Related U.S. Application Data

(60) Provisional application No. 61/365,947, filed on Jul. 20, 2010.

(56) References Cited

U.S. PATENT DOCUMENTS 1,909,095 A * 5/1933 Coffin, Jr. ..... F04D 29/167 277/429
1,942,518 A * 1/1934 Protin ..... F16L 15/001 285/115
2,010,525 A 8/1935 McHugh
2,148,740 A 2/1939 Fuqua
2,283,348 A 12/1939 Adams et al.
2,267,923 A * 12/1941 Johnson ..... F16B 33/02 285/334
2,364,168 A 12/1944 Shallenberg
2,528,210 A 12/1946 Stewart
2,802,679 A 6/1953 Taltavall, Jr.
2,885,225 A 2/1955 Rollins
2,800,860 A 7/1957 Heath
3,129,963 A * 4/1964 Robbins ..... F16L 15/001 285/334
3,130,679 A 4/1964 Sence
3,388,752 A * 6/1968 Huntsinger ..... E21B 17/01 173/131
3,601,501 A 8/1971 Johnson
3,977,737 A 8/1976 Grzina
4,003,678 A 1/1977 David
4,032,256 A 6/1977 Tatkov et al.
4,121,862 A * 10/1978 Greer ..... F16L 15/001 285/333
4,444,421 A * 4/1984 Ahistone ..... E02D 5/523 285/334
4,509,773 A 4/1985 Wentworth
4,521,151 A 6/1985 Frater et al.
4,531,847 A 7/1985 F'Geppert
4,609,212 A * 9/1986 Hosang ..... E21B 17/08 285/334
4,717,183 A * 1/1988 Nobileau ..... E21B 17/042 285/334
4,981,406 A * 1/1991 Weiss ..... F16B 35/047 411/386
5,192,142 A 3/1993 Hyll
5,344,291 A 9/1994 Antkowiak
5,597,289 A 1/1997 Thut
5,704,124 A 1/1998 Trauzettel
5,961,524 A 10/1999 Crombie
5,984,627 A 11/1999 Ramsay
6,123,523 A 9/2000 Cooper
6,158,938 A 12/2000 Savoji
6,273,914 B1 8/2001 Papas
6,283,702 B1 9/2001 Devlugt et al.
6,303,074 B1 10/2001 Cooper
6,663,343 B1 12/2003 Anderson
6,689,310 B1 2/2004 Cooper
7,010,013 B2 3/2006 Wang et al.
7,074,017 B2 * 7/2006 Coray ..... F04D 13/021 29/888.021
7,182,579 B2 2/2007 Roso et al.
7,438,519 B2 10/2008 Torres-Reyes
7,455,329 B2 * 11/2008 Muradov ..... E21B 17/042 285/333
7,556,766 B2 7/2009 Yu et al.
7,731,891 B2 6/2010 Cooper
2003/0155769 A1 * 8/2003 Haines ..... E21B 17/042 285/333
2004/0262825 A1 12/2004 Cooper
2007/0289510 A1 12/2007 Park
2008/0012321 A1 * 1/2008 Roussie ..... E21B 17/042 285/334
2008/0152476 A1 6/2008 Melo
2012/0051905 A1 3/2012 Davis et al.

* cited by examiner

IMPELLER ATTACHMENT METHOD

CROSS REFERENCE TO RELATED PATENT APPLICATION

This is a continuation application that claims benefit to parent patent application Ser. No. 13/186,647, filed 20 Jul. 2011, which itself claims benefit to provisional patent application Ser. No. 61/365,947, filed 20 Jul. 2010, and which are both hereby incorporated by reference in their entirety.

BACKGROUND OF THE INVENTION

1. Field of the Invention

This invention relates to a pump; and more particularly relates to a new technique for attaching an impeller to a shaft in a pump, including a centrifugal pump or a slurry-type pump.

2. Description of Related Art

Current pump designs use straight (cylindrical) threads of various forms to attach an impeller to a power transmission shaft in a pump. While inexpensive, this method of attachment presents several difficulties for maintenance personnel, including alignment requirements to start threads that are difficult to maintain in field conditions (large, heavy parts must be aligned precisely with inadequate lifting equipment), the tendency of standard thread forms to cross thread if slightly misaligned, and the large number of turns required to seat the shaft threads in the impeller.

By way of example, there are known techniques for attaching an impeller to a shaft in a pump, including that disclosed in U.S. Pat. No. 2,364,168, which sets forth a connection of an impeller shaft to a motor shaft using a tapered thread connection having on one end an impeller, a threaded tapered shaft, and a threaded nut. However, in the technique disclosed in the '168 patent, 1) Torque is transmitted from the shaft to the impeller through a split hub on the impeller. A nut on a tapered thread tightens the hub against the motor shaft.
2) There is no "direct" connection of the impeller to the shaft as is accomplished in current threaded-shaft/threaded impeller bore designs.
3) While the front of the impeller uses a nut threaded on a tapered shaft, it appears to be used only for positioning the impeller.

See also the technique disclosed in U.S. Pat. No. 6,663,343, which sets forth an impeller mounting system, wherein an impeller shaft has tapered threads for merely engaging a collar.

In view of this, there is a need in the industry for a technique for attaching the impeller to the power transmission shaft that reduces problems associated with alignment requirements to start threads that are difficult to maintain in field conditions (large, heavy parts must be aligned precisely with inadequate lifting equipment), the tendency of standard thread forms to cross thread if slightly misaligned, and the large number of turns required to seat the shaft threads in the impeller.

SUMMARY OF THE INVENTION

According to some embodiments, the present invention may take the form of apparatus, such as a pump, having an impeller in combination with a power transmission shaft.

The impeller has a tapered bore with impeller threads. The power transmission shaft has a shaft end with tapered threads configured to couple directly to the impeller threads of the tapered bore of the impeller, to transmit torque directly through the tapered threads, and to provide self axial alignment even if the coupling of the tapered threads and the impeller threads of the tapered bore start out of alignment. The tapered thread configuration substantially reduces investment in lifting equipment and time because it eliminates the need for maintenance personnel to precisely align the impeller's threads and the shaft's threads before attaching or removing the impeller, and the tapered threads release much more quickly from the impeller than a standard thread configuration, reducing the number of turns the power transmission shaft must be rotated by hand to free it from the impeller.

According to some embodiments, the present invention may take the form of apparatus such as a pump assembly, arrangement or combination, as well as other types or kinds of rotating machinery or equipment, including a compressor or fan, featuring an impeller in combination with a shaft, where the impeller has a tapered bore with impeller threads; and where the shaft has a shaft end with tapered threads configured to couple directly to the impeller threads of the tapered bore of the impeller, to transmit torque directly through the tapered threads, and to provide self alignment even if the coupling of the tapered threads and the impeller threads of the tapered bore starts out of alignment. The self alignment includes both axial and radial alignment. The tapered thread and the impeller threads are configured in combination to substantially eliminate the need to precisely align the impeller threads and the tapered threads before attaching or removing the impeller, and the tapered threads are configured to release quickly from the impeller threads when compared to a standard thread configuration, reducing the number of turns the shaft must be rotated to be removed from the impeller.

Use of a tapered thread according to the present invention reduces maintenance needs (time, training and equipment) by providing a method of attachment that will self align even if started out of alignment. The tapered thread reduces investment in lifting equipment and time because it eliminates the need for maintenance personnel to precisely align the impeller and shaft threads before attaching or removing the impeller. Additionally, the tapered thread releases much more quickly from the impeller than a standard thread, reducing the number of turns a shaft must be rotated by hand to free it from the impeller.

By way of example, the pump or pump assembly, arrangement or combination may take the form of a slurry-type pump or centrifugal pump.

Some features and advantages of the present invention also include:

The torque required to drive the impeller is transmitted through the threads.

There is less movement of a potentially heavy part (impeller), thus

Fewer turns to completely disengage the threads, and

Less axial distance travelled.

The tapered threads allow the impeller to self-align, even if it is presented to the shaft Eccentrically, or Angularly.

Less time is required for both disassembly and reassembly, as the shaft will be reused many times during the lifetime of the unit, while impellers are used only once then discarded when worn out.

The eccentricity of the impeller relative to the shaft is reduced due to a turn on the shaft mating closely with a counterbore on the impeller. The reduction in eccentricity further manifests itself in reduced vibration of the operating unit. In general, reduced vibration leads to longer operating life.

One advantage of the present invention is that the impeller may disengage in as few as about 3-5 turns of the shaft, as opposed to having to travel the entire length of the thread of the shaft/impeller. Axial movement before disengaging is approximately 1 inch. Experimentation has also indicated that, even when there is misalignment of the impeller and shaft angularly and longitudinally, the threads have typically engaged and aligned the impeller to the shaft.

These and other features, aspects, and advantages of embodiments of the invention will become apparent with reference to the following description in conjunction with the accompanying drawing. It is to be understood, however, that the drawing is designed solely for the purposes of illustration and not as a definition of the limits of the invention.

BRIEF DESCRIPTION OF THE DRAWINGS

The drawing, which is not necessarily to scale, include the following Figures.

In the following description of the exemplary embodiment, reference is made to the accompanying drawings, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

Figure 1:
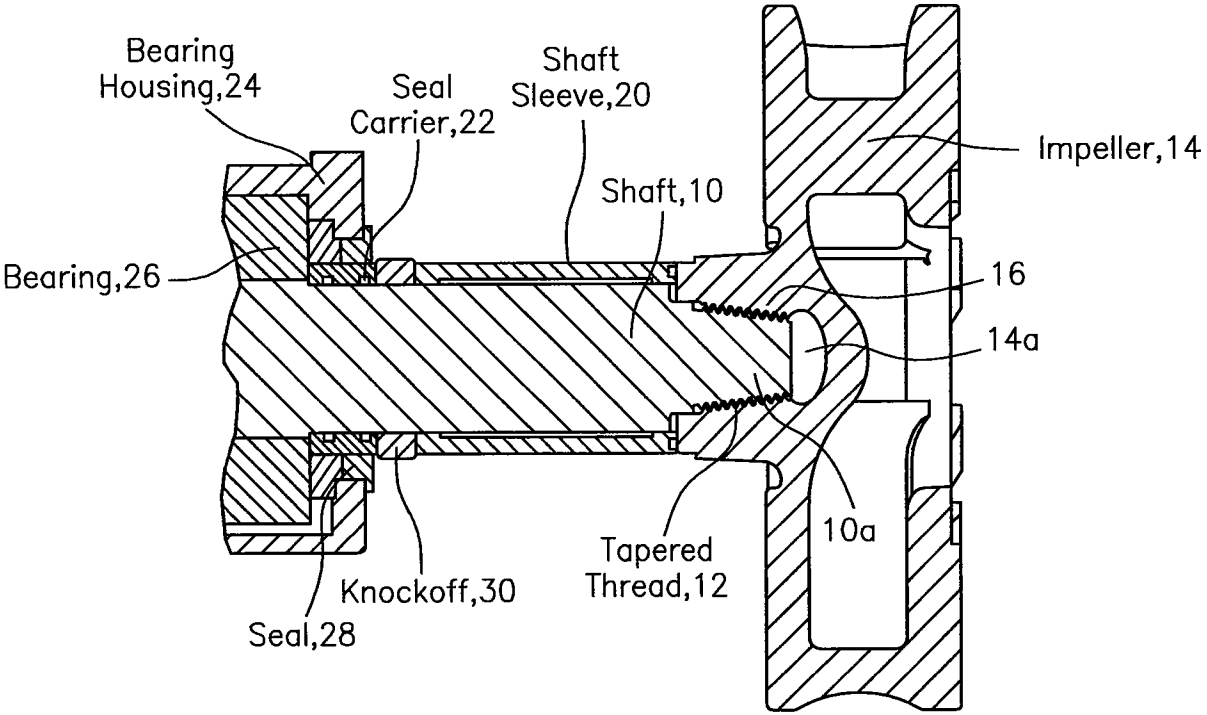
FIG. 1 shows a diagram of a shaft having tapered threads coupled to an impeller with corresponding tapered threads according to some embodiments of the present invention.

FIG. 1 shows the basic invention in the form of apparatus such as an assembly, arrangement or combination that includes a shaft 10 having an end 10*a* with tapered threads 12 coupled to an impeller 14 having a bore 14*a* with corresponding tapered impeller threads 16 formed therein, according to some embodiments of the present invention. The impeller shaft 10 and the impeller 14 form part of apparatus, such as a pump assembly, arrangement or combination consistent with that shown in FIGS. 2-3 herein. As shown, the impeller shaft 10 is coupled directly to the impeller 14 so that the tapered threads 12 of the shaft 10 rotationally mate and frictionally engage the corresponding tapered impeller threads 16 of the impeller 14 to transmit torque directly through the tapered threads 12, and to provide self alignment even if the coupling of the tapered threads 12 and the impeller tapered threads 16 of the tapered bore 14*a* start out of alignment. The tapered thread configuration substantially reduces investment in lifting equipment and time because it eliminates the need for maintenance personnel to precisely align the tapered impeller threads 16 and the tapered threads 12 before attaching or removing the impeller 14, and the tapered threads 12 release much more quickly from the impeller 14 than a standard thread configuration, reducing the number of turns the shaft 10, including for example, a power transmission shaft as discussed below, must be rotated by hand to free it from the impeller 14.

By way of example, according to some embodiments of the present invention, the tapered threads 12 may be configured based at least partly on using an API (American Petroleum Institute) regular tapered thread, although the scope of the invention is not intended to be limited to any particular size, type or kind of tapered thread. Embodiments of the present invention are also envisioned using other types or kinds of tapered threads in addition to the aforementioned API (American Petroleum Institute) tapered thread either now known or later developed in the future. By way of example, in some embodiments of the present invention a configuration having a pitch of 5 threads per inch may be used, although the scope of the invention is not intended to be limited to any particular number of threads per inch. Embodiments are envisioned using other configurations with other pitches depending on the particular application. By way of further example, in other embodiments of the present invention, a configuration having a 1 in 4 taper (i.e., 1 inch of diameter reduction for 4 inches of axial length), although the scope of the invention is not intended to be limited to any particular taper reduction. Embodiments are envisioned using other configurations with other taper reductions depending on the particular application.

In FIG. 1, the arrangement, assembly or combination according to the present invention is shown in relation to other parts that do not form part of the underlying invention, including a shaft sleeve 20, a seal carrier 22, a bearing housing 24, a bearing 26, a seal 28 and a knockoff 30, which are parts that are known in the art, and that can be used in a pumping arrangement in relation to the shaft 10, as one skilled in the art would appreciate. The present invention is not intended to be limited to using the same in relation to these other parts 20, 22, . . . , 30; and embodiments of the present invention are envisioned in which the present invention is used with, and forms parts of, other equipment, apparatus or devices having both the same parts 20, 22, . . . , 30 in the same arrangement as, or in a different arrangement than, that shown in FIG. 1, as well as different other parts in a corresponding different arrangement than that shown in FIG. 1. The arrangement, assembly or combination according to the present invention may also work in relation to, or in cooperation with, other parts that are not shown herein, including chamfers on the shoulder of the shaft behind the tapered threads and in the straight bore of the impeller to help guide the impeller onto the shaft and allow it to tighten properly.

Figure 2:
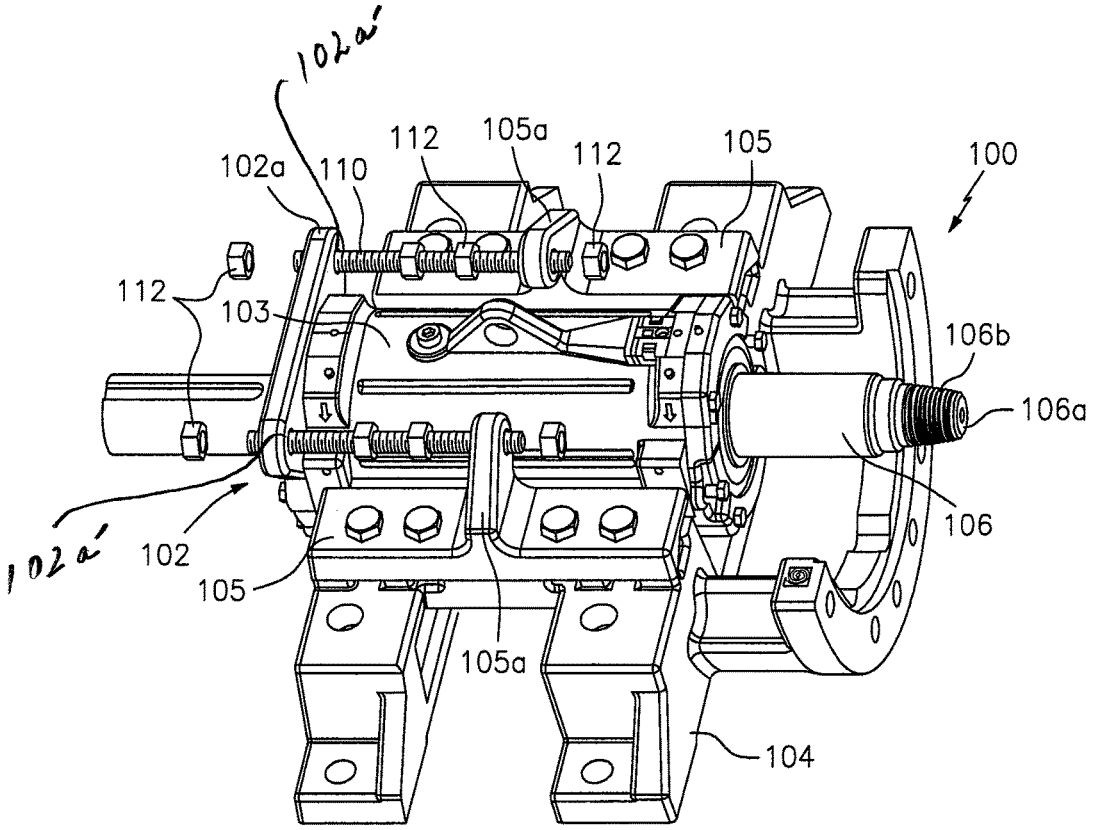
FIG. 2 shows a top perspective view of a powerframe having a shaft with tapered threads according to some embodiments of the present invention.
Figure 3:
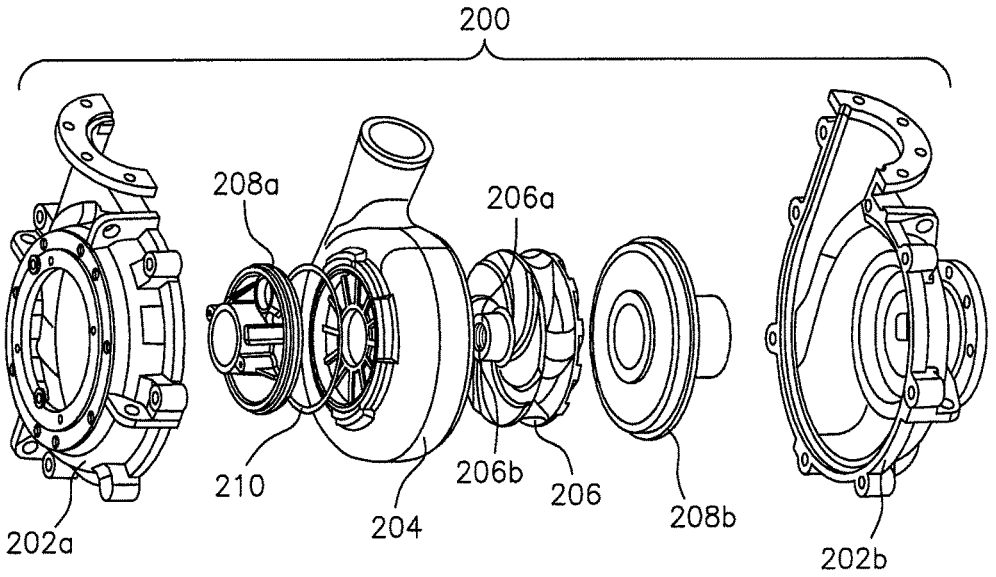
FIG. 3 shows an exploded view of a pumping arrangement having an impeller with corresponding tapered impeller threads according to some embodiments of the present invention.

By way of example, the present invention is described in relation to the pump assembly, arrangement or combination shown in FIGS. 2-3, although the scope of the invention is intended to include apparatus, such as other types or kinds of rotary equipment, assemblies, arrangements, devices or combinations having a rotating shaft coupled directly to an impeller, that are either now known or later developed in the future. For example, FIGS. 2-3 show apparatus in the form of a pump assembly, arrangement or combination, where FIG. 2 shows a combination generally indicated as 100 of a power frame 102, a pedestal 104 and a power transmission shaft 106, and where FIG. 3 shows a pumping assembly combination generally indicated as 200 having outer casing sub-components 202*a* and 202*b*, a pump or volute liner 204, an impeller 206, front and rear liners and/or covers 208*a*, 208*b* and a gasket 210. The power transmission shaft 106 has an end 106*a* with tapered threads 106*b*. The impeller 206 has a bore 206*a* having corresponding threads 206*b*. When assembled, the power transmission shaft 106 is coupled directly to the impeller 206 so that the tapered threads 106*b* of the power transmission shaft 106 rotationally mate and frictionally engage the corresponding tapered threads 206*b* of the impeller 206.

The power frame 102 has an end cover 102*a* having bores and turns (unlabeled). The pedestal 104 also has hold down plates 105 having wings 105*a* with holes that penetrate to allow threaded bolts or rods 110 to pass through. A bearing cartridge 103 is mounted in the pedestal 104 on wings (not shown) that mate with machined grooves or ways (not shown) in the pedestal 104. The combination 100 also includes threaded bolts or rods 110 arranged in holes of the end cover 102*a* and the corresponding holes in the wings 105*a*. The combination 100 also includes nuts 112 for adapting on the threaded bolts or rods 110, which may be loosened and tightened in a manner that would be appreciated by one skilled in the art without undue experimentation in order to move, slide or adjust the power frame 102 and bearing cartridge 103 in relation to the pedestal 104, and further in relation to the pumping assembly combination 200. The hold-down plates 105 are configured to clamp the bearing cartridge 103 in the pedestal 104 to prevent its movement after it has been appropriately adjusted, and are also configured with grooves machined therein (not shown). Appropriate pairs of nuts 112 are suitably tightened on both sides of the end plate 102*a* and the wings 105*a* in order to secure the bearing cartridge 103 in relation to pedestal 104 and the pumping assembly combination 200.

The other parts of the pumping assembly combination 200 shown in FIG. 3, including the outer casing sub-components 202*a* and 202*b*, the pump or volute liner 204, the front and reap liners and/or covers 208*a*, 208*b* and the gasket 210 do not form part of the underlying invention, are known in the art, and are not described in detail herein.

SCOPE OF THE INVENTION

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes, in form and shape, may be made therein without departing from the scope and spirit of the invention as set forth above.

I claim:

1. A method for aligning and attaching an impeller to a power transmission shaft of a slurry-type pump, the method comprising:

lifting the impeller which has a bore with corresponding tapered impeller threads in relation to a power transmission shaft having an end with tapered shaft threads; and when the tapered shaft threads and the corresponding tapered impeller threads start out of alignment:

rotating the power transmission shaft 3-5 turns on its transmission shaft axis in a rotational direction, wherein the tapered shaft threads of the power transmission shaft are configured to provide eccentrical, angular, axial and radial self alignment of the impeller to the power transmission shaft as the tapered shaft threads of the power transmission shaft are rotated to frictionally engage and couple to the corresponding tapered impeller threads of the impeller, and upon completion of the coupling in 3-5 turns of the tapered shaft threads to the tapered impeller threads, the power transmission shaft directly transmits torque through the tapered shaft threads to the corresponding tapered impeller threads.

2. The method according to claim 1, wherein the method further comprises rotating the power transmission shaft to release the tapered shaft threads of the power transmission shaft from the corresponding tapered impeller threads of the impeller.

3. The method according to claim 2, wherein the method further comprises rotating the power transmission shaft a corresponding 3-5 turns in an opposite rotational direction to release the tapered shaft threads of the power transmission shaft from the corresponding tapered impeller threads of the impeller, causing an axial movement before disengaging of about 1 inch.

4. The method according to claim 2, wherein the method comprises rotating the power transmission shaft by hand.

5. The method according to claim 1, wherein the method comprises lifting the impeller with lifting equipment.

6. The method according to claim 1, wherein the method comprises moving, sliding or adjusting a bearing cartridge having the power transmission shaft rotationally arranged therein in relation to a pedestal and a pumping assembly combination that includes the impeller.

7. The method according to claim 1, wherein the method comprises configuring the tapered shaft threads and the corresponding tapered impeller threads with a pitch of 5 threads per inch.

8. The method according to claim 1, wherein the method comprises configuring the tapered shaft threads and the corresponding tapered impeller threads with a 1 in 4 taper, including where 1 inch of diameter reduction is used for 4 inches of axial length.

9. A slurry pump, comprising:

a pumping assembly combination configured with a casing having first and second outer casing subcomponents and an impeller arranged therein, the impeller configured with a tapered bore having tapered impeller threads formed therein; and a combination of a power frame, a pedestal, and a bearing cartridge, wherein the bearing cartridge is mounted on the pedestal and configured with a power transmission shaft arranged therein, the combination being configured to slide the power frame and bearing cartridge in relation to the pedestal and the first outer casing subcomponent of the casing of the pump assembly combination along an axis of the power transmission shaft when attaching the impeller to the power transmission shaft during assembly and when removing the impeller from the power transmission shaft during disassembly, the power transmission shaft having a tapered shaft end with tapered shaft threads configured to provide eccentrical, angular, axial and radial self alignment of the impeller to the power transmission shaft when the tapered shaft threads and the tapered impeller threads start out of alignment as the tapered shaft threads of the power transmission shaft are rotated 3-5 turns to couple directly to, and rotationally mate and frictionally engage with, the tapered impeller threads of the tapered bore of the impeller along the axis of the power transmission shaft, so as to upon completion of the 3-5 turns transmit torque directly through the tapered shaft threads when the power frame and bearing cartridge are slid in relation to the pedestal and the first outer casing subcomponent of the casing of the pump assembly combination during the self alignment of the tapered impeller threads of the impeller of the pump assembly combination and the tapered shaft threads of the tapered shaft end of the power transmission shaft;

wherein the tapered impeller threads and the tapered shaft threads form a tapered thread configuration that reduces a need for lifting equipment and time required for the assembly and disassembly of the impeller and the power transmission shaft, eliminates a need for a precise alignment of the tapered shaft threads and the tapered impeller threads when the power transmission shaft is attached to the impeller, and reduces a number of turns to release the tapered shaft threads from the tapered impeller threads when the power transmission shaft is removed from the impeller.

10. The slurry pump according to claim 9, wherein the power frame includes an end cover having bores and turns;

the pedestal includes hold down plates having wings configured with holes that penetrate to allow threaded bolts or rods to pass through; and the combination includes nuts for adapting on the threaded bolts or rods in order to slide the power frame and bearing cartridge in relation to the pedestal and the pump assembly combination during the alignment.

11. The slurry pump according to claim 9, wherein the tapered shaft threads and the tapered impeller threads include a configuration having one of a pitch of about 5 threads per inch, a 1 in 4 taper taking the form of about 1 inch of diameter reduction for 4 inches of axial length, or a combination of the tapered shaft threads and the tapered impeller threads includes a configuration having a pitch of about 5 threads per inch, and the tapered shaft threads and the tapered impeller threads having about a 1 in 4 taper taking the form of about 1 inch of diameter reduction for 4 inches of axial length.

12. The slurry pump according to claim 9, wherein the casing includes casing sub-components configured with a pump or volute liner therein.

13. A method of attachment of a combination of a power frame, a pedestal, a bearing cartridge, and a power transmission shaft to a pumping assembly combination of a slurry pump, the method comprising:

configuring a pumping assembly combination with a casing having first and second outer casing subcomponents and an impeller arranged therein that has a tapered bore having tapered impeller threads formed therein;

configuring a combination of a power frame, a pedestal, and a bearing cartridge, wherein the bearing cartridge is mounted on the pedestal and configured with a power transmission shaft arranged therein having a tapered shaft end with tapered shaft threads, so that the power frame and bearing cartridge can be slid in relation to the pedestal and the first outer casing subcomponent of the casing of the pump assembly combination along an axis of the power transmission shaft when attaching the impeller to the power transmission shaft during assembly and when removing the impeller from the power transmission shaft during disassembly;

sliding the power frame and bearing cartridge in relation to the pedestal and the pump assembly combination along the axis of the power transmission shaft; and when the tapered shaft threads and the tapered impeller threads start out of alignment:

rotating the power transmission shaft 3-5 turns on its transmission shaft axis in a rotational direction, wherein the tapered shaft threads of the power transmission shaft are configured to provide eccentrical, angular, axial and radial self alignment of the impeller to the power transmission shaft as the tapered shaft threads of the power transmission shaft are rotated to frictionally engage and couple to the corresponding tapered impeller threads of the impeller, and upon completion of the coupling in 3-5 turns of the tapered shaft threads to the tapered impeller threads, the power transmission shaft directly transmits torque through the tapered shaft threads to the corresponding tapered impeller threads when the power frame and bearing cartridge are slid in relation to the pedestal and the pump assembly combination during the alignment of the tapered impeller threads of the impeller of the pump assembly combination and the tapered shaft threads of the tapered shaft end of the power transmission shaft;

wherein, the tapered impeller threads and the tapered shaft threads form a tapered thread configuration that reduces a need for lifting equipment and time required for the assembly and disassembly of the impeller and the power transmission shaft, eliminates a need for a precise alignment of the tapered shaft threads and the tapered impeller threads when the power transmission shaft is attached to the impeller, and reduces a number of turns to release the tapered shaft threads from the tapered impeller threads when the power transmission shaft is removed from the impeller.

14. The method according to claim 13, wherein the method further comprises:

configuring the power frame with an end cover having bores and turns;

configuring the pedestal with hold down plates having wings configured with holes that penetrate to allow threaded bolts or rods to pass through; and adapting nuts in the combination on the threaded bolts or rods in order to slide the power frame and bearing cartridge in relation to the pedestal and the pump assembly combination during the alignment.

15. The method according to claim 13, wherein the method comprises:

configuring the tapered shaft threads and the tapered impeller threads with one of a pitch of about 5 threads per inch, a 1 in 4 taper taking the form of about 1 inch of diameter reduction for 4 inches of axial length, or a combination of the tapered shaft threads and the tapered impeller threads with a pitch of about 5 threads per inch, and the tapered shaft threads and the tapered impeller threads with about a 1 in 4 taper taking the form of about 1 inch of diameter reduction for 4 inches of axial length.

16. The method according to claim 13, wherein the method comprises configuring the casing with casing subcomponents having a pump or volute liner arranged therein.

* * * * *